United States Patent [19]

Rice

[11] 3,937,472

[45] Feb. 10, 1976

[54] EDUCATIONAL AND AMUSEMENT PUZZLE

[76] Inventor: David W. Rice, 3728 Boomer Road, Cincinnati, Ohio 45239

[22] Filed: June 9, 1975

[21] Appl. No.: 584,896

[52] U.S. Cl. ..... 273/157 R; 35/31 D; 35/31 G; 35/73

[51] Int. Cl.[2] ..... A63F 9/10

[58] Field of Search..... 273/157 R; 35/31 D, 31 G, 35/70, 73

[56] References Cited

UNITED STATES PATENTS

| | | | |
|---|---|---|---|
| 1,228,356 | 5/1917 | Brennan | 35/31 G |
| 1,405,063 | 1/1922 | Murray | 35/73 X |
| 1,843,183 | 2/1932 | Thompson | 35/31 G UX |
| 2,123,758 | 7/1938 | Wentzel | 273/157 R UX |
| 3,171,214 | 3/1965 | Sutherland | 273/157 R |
| 3,212,201 | 10/1965 | Jensen | 273/157 R |

FOREIGN PATENTS OR APPLICATIONS

| | | | |
|---|---|---|---|
| 1,208,949 | 10/1970 | United Kingdom | 35/73 |
| 1,548,604 | 10/1968 | France | 273/157 R |

*Primary Examiner*—Anton O. Oechsle
*Attorney, Agent, or Firm*—Olsen and Stephenson

[57] ABSTRACT

A puzzle is disclosed that is comprised of a plurality of cards that partially overlap each other so that, when completely assembled, the combined exposed portions provide a picture; the non-exposed portions provide areas for assembly information. The matching of the assembly information is a guide to assemble the puzzle. In one form, a card holder can be used to facilitate the positioning of the cards. In another form, the cards simply attach to each other.

15 Claims, 17 Drawing Figures

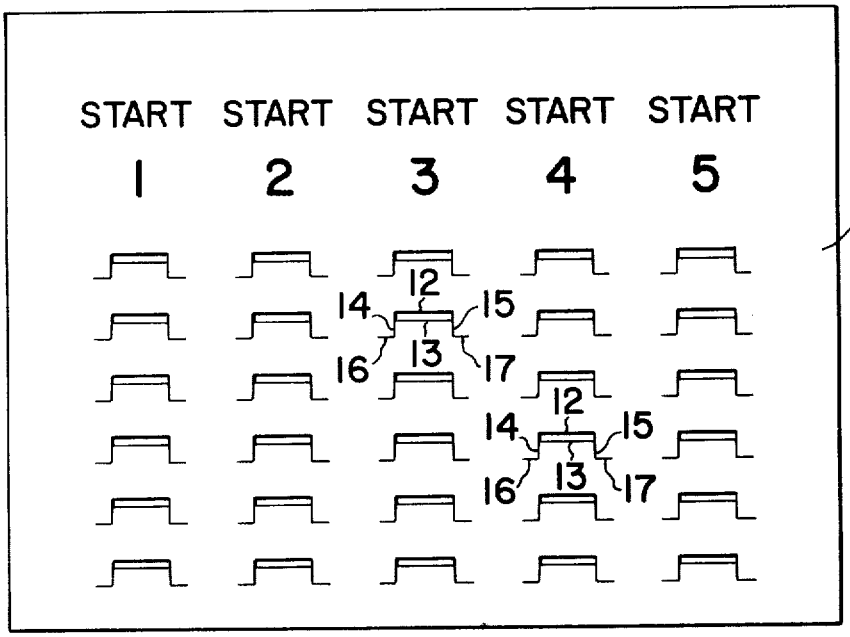
FIG. 1
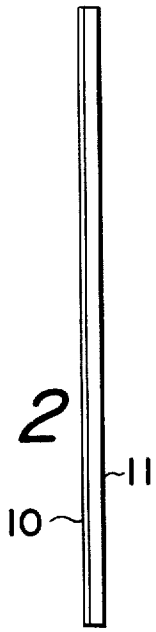
FIG. 2
FIG. 3
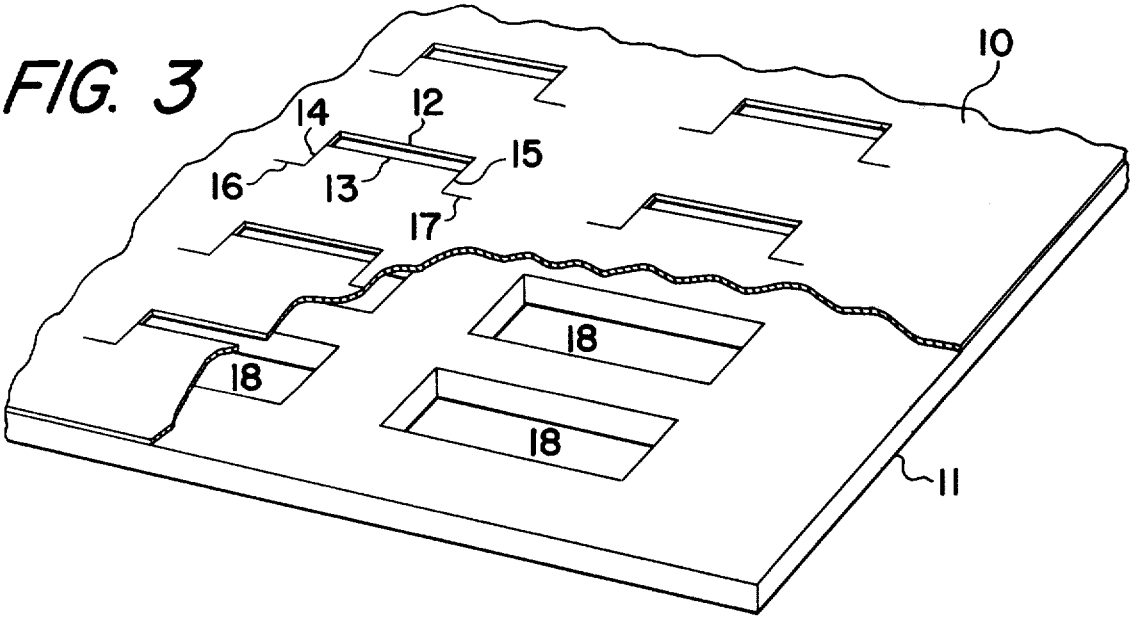
FIG. 4
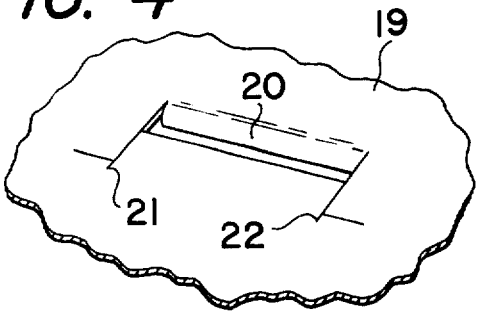

EDUCATIONAL AND AMUSEMENT PUZZLE

BACKGROUND OF THE INVENTION

This invention generally relates to puzzles that are assembled by matching assembly information on adjacent cards and, more particularly, to the type of puzzle in which a picture is formed through the correct responses to a quiz or set of quiz-like associations.

Numerous puzzles and games provide people of all ages with many hours of entertainment, but provide very little if any educational experience. However, educational experience gained from memorizing facts, reading flash cards or rote learning of any kind often involves mind-numbing drill which can destroy interest and motivation for learning. Furthermore, educational experience of this type usually requires outside assistance for direction, encouragement and grading.

Although teachers have long recognized the usefulness of drill, drill as such has been downgraded in many educational circles because it is associated with old-style, authoritarian methods, and because it often fails to stimulate interest in the learner. This invention takes into account both the usefulness of drill and the importance of interest arousal. This invention can serve the repetitive function of drill, but it can also serve to stimulate and to motivate the learner by providing a sense of accomplishment and pleasure as the picture takes shape and finally is completed when all the correct associations have been made.

The principal object of this invention is to provide a novel puzzle that has the combined benefits of being educational, entertaining, self-teaching and self-correcting. The puzzle can be made to give educational experience on any subject such as math, history, language, sports, literature, etc. and on any achievement level. The formation of a picture through the correct responses to a quiz or matching of quiz-like associations provides entertainment. Self-teaching is achieved through the process of reading, thinking, searching among alternatives and responding without outside assistance. Self-correction occurs when the incorrect formation of the picture is observed, thus indicating incorrect responses to the educational material.

Several known picture and quiz-type puzzles require apparatus to accommodate part of the quiz and response information, in addition to the puzzle pieces. U.S. Pat. No. 1,701,557 (D. Clinch et al, Feb. 12, 1929) requires a column of questions or instructions on a separate folder, in addition to the puzzle pieces. U.S. Pat. No. 2,481,109 (M. C. Grace, Sept. 6, 1949) requires a set of cards that contain information, in addition to the puzzle pieces. Tray Puzzles (currently manufactured by Ideal School Supply Co.) require an answer tray, in addition to the puzzle pieces.

Accordingly, one object of this invention is to provide apparatus which incorporates all quiz and response information or quiz-like information on the puzzle pieces. This has the advantage of simplifying the apparatus over these previously known puzzles.

U.S. Pat. No. 3,171,214 (A. Sutherland, Mar. 2, 1965) describes a method that includes all quiz and response information on the puzzle pieces, but this method provides an area no larger than the picture segments. This greatly restricts the amount of quiz and response information necessary for educational value, particularly for puzzles comprising a large number of pieces.

Accordingly, another object of this invention is to provide a considerably larger area on each puzzle piece than the picture segment; the area does not decrease for puzzles comprising a large number of pieces. This enables the quiz and response information or quiz-like information to be in the form of pictures, sentences, paragraphs and brief stories, which can greatly expand and improve the educational value.

Still another object of this invention is to provide a puzzle that is simple and economical to produce. This makes it possible for more people to afford this type of educational puzzle over other known educational puzzles.

Another important advantage of this invention is the ease of handling and storing the puzzle pieces, since they are in the form of cards (similar to ordinary playing cards). This would appeal to the people who enjoy the manipulating of playing cards.

Although this puzzle is ideally suited for one person, several people can play as a cooperative or competitive game. Each player can be assigned to assemble a particular portion of the puzzle or points can be awarded to the player who finds the correct match.

These and other objects and advantages of this invention will be more readily apparent from a consideration of the summary and the description of the several forms of this invention.

SUMMARY OF THE INVENTION

One form of apparatus based on this invention comprises a plurality of cards and a card holder. The cards are designed to partially overlap each other, when placed on the card holder, so that exposed portions of the cards form a picture. The cards also contain assembly information which is used as a guide to assemble the puzzle.

The card holder provides a series of open slots to receive the cards individually. The slots and the cuts extending from the slots are designed to position and releasably hold the cards substantially flat against each other so that exposed picture segments can be easily viewed. The lower edge of each slot is also the upper edge of a tab which is forced to raise slightly when a card is inserted. The pressure of the tab against the inserted card acts to hold the position of the card. Cuts extending from both sides of the base of each tab automatically provide a stop as each card is inserted.

The cards can be made similar to ordinary playing cards as to size, material and thickness. A tab is provided at the bottom of each card as a means to insert the card into a slot in the card holder.

The cards can be divided into three classes: the "beginning cards," the "middle cards" and the "end cards." The face of each card displaying the picture segment will hereafter be referred to as the top side.

The top side of each "beginning card" is divided into two areas; one area contains the picture segment and the other area contains the assembly information. The underside of each "beginning card" contains start information.

The top side of each "middle card" is also divided into two areas; one area contains the picture segment and the other area contains the assembly information. The underside of each "middle card" contains assembly information.

The entire top side of each "end card" contains a picture segment and the underside contains assembly information.

The inspection of the picture segments is not intended to be used as a means to assemble the puzzle, but only to indicate mistakes. The puzzle is to be assembled by matching assembly information located on the cards, which can be in the form of any suitable associations of letters, words, phrases, sentences, paragraphs, brief stories, pictures, symbols, numerals, clues and any combination thereof. For example, in the brief story and picture categories, the descriptions of various species of birds as to size, color, habits, locale, etc. can be matched to pictures in color of the various birds.

Picture segments that do not visually align, in form and color, to adjacent picture segments, indicate that an improper association between the assembly information has been made. A mistake can be immediately noted so that one will not assume a correct response has been made. This will prevent confusion that can result from discovering errors after a period of time, and then unlearning what was thought to be true.

The puzzle is assembled as follows:

The "beginning cards" are inserted into the top row of slots of the card holder. The marking "START 1," "START 2," "START 3," etc. on the underside of each "beginning card" is matched to the marking "START 1," "START 2," "START 3," etc. on the face of the card holder respectively. The picture segment and assembly information on the top side of each "beginning card" is now displayed.

The remaining "middle cards" and "end cards" are now shuffled to minimize logical order.

The assembly information on the underside of each card is now read and compared to the assembly information displayed on the "beginning cards". When a likely match is found, the "middle card" is inserted into the slot immediately below the slot occupied by the "beginning card." This "middle card" covers the assembly information on the "beginning card," and now displays new assembly information. If a correct match has been made, the form and color of the picture segments will align. The assembly information on the top side of a correctly positioned "middle card" can now be used.

As the assembly information is matched, the cards are inserted into the card holder, one immediately below the other, until all cards are in place.

In another form, based on this invention, the apparatus comprises only a plurality of cards. The cards are designed to partially overlap each other, when attached to each other, so that exposed portions of the cards form a picture. The cards also contain assembly information which is used as a guide to assemble the puzzle, exactly as described in the first form of this invention.

A tab is provided at the top of each "middle card" and each "end card" for a means to insert the card into an opening in any "beginning card" or other "middle card". Cuts formed in the face of each "beginning card" and each "middle card" provide the means for forming the opening during assembly of the puzzle. The cuts are also designed to position and releasably hold the cards substantially flat against each other so that exposed picture segments can be easily viewed.

A tab immediately above the opening in each "beginning card" and each "middle card" is forced to raise slightly when a card is inserted. The pressure of the tab against the inserted card acts to hold the position of the cards with respect to each other.

The puzzle is assembled in columns, starting with each "beginning card." As described in the first form of this invention, it is intended for the puzzle to be assembled only by matching related assembly information. When all columns are completely assembled, they are placed next to each other to form the entire picture.

In one modification, the widths of several cards can be increased so that they are common to two or more columns. This will hold the columns together and provide increased areas for the assembly information. This would be particularly useful for assembly information consisting of pictures.

A modification can also be made to the tab at the top of each "middle card" and each "end card". This will lock the cards together to prevent the cards from slipping with respect to each other while the puzzle is being assembled. Each tab is also designed to enable the cards to be easily unlocked from each other.

In the drawings:

FIG. 1 is a front view of the card holder.

FIG. 2 is a side view of the card holder.

FIG. 3 is a perspective view of a portion of the card holder.

FIG. 4 is a perspective view of a portion of a modified form of the card holder.

DESCRIPTION OF THE INVENTION

Figure 5:
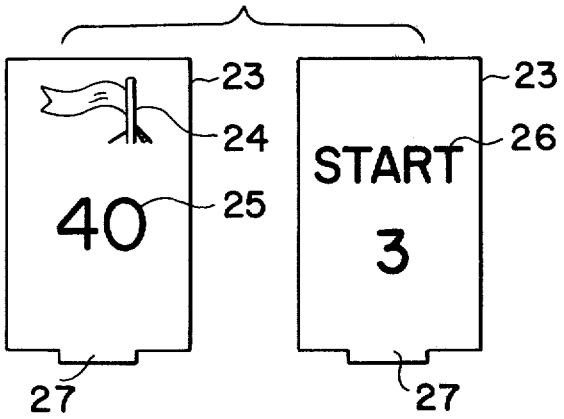
FIG. 5 is a front and rear view of a "beginning card."

A front view on the entire card holder is shown in FIG. 1. The card holder consists of a front layer 10 which is bonded to a rear layer 11 as shown in FIG. 2. Heavy paper, cardboard, plastic or the like are suitable materials for both layers 10 and 11. The cards are held entirely by the front layer 10. The front layer 10 is relatively thin which can be approximately twice the thickness of ordinary playing cards. The rear layer 11 provides a space directly below each slot and adds strength to the card holder.

All cuts made in the face of the card holder which include the formation of the slots and the cuts extending from the slots will hereafter be referred to as face cuts.

The front layer 10 provides a series of identical slots and face cuts extending from the slots which are arranged in five columns and six horizontal rows. Face cuts 12 and 13 represent the upper edge and the lower edge of any slot in the front layer 10. "START 1," "START 2," "START 3," "START 4" and "START 5" are printed over the columns as shown in FIG. 1.

The number of columns and rows can vary according to the intended difficulty of the puzzle. For preschool children, a card holder providing only one column of three slots can be sufficient. For adults, a card holder providing 10 columns and 10 rows of slots would make a challenging puzzle.

The construction of a typical slot and the face cuts extending from the slot is best shown in FIG. 3. All face cuts are entirely through the front layer 10. Face cuts forming the left edge 14 and the right edge 15 of a typical slot extend to meet perpendicular face cuts 16 and 17 respectively. The lower edge 13 of a typical slot is also the upper edge of a tab formed by face cuts 13, 14 and 15.

All tabs formed from face cuts 13, 14 and 15 will hereafter be referred to as face tabs. The point where face cuts 14 and 16 meet and the point where face cuts 15 and 17 meet define the base of a typical face tab. Thus, face cuts 16 and 17 are located on each side of the base of a typical face tab and extend away from each other.

A tab located on the bottom edge of each card, hereafter referred to as an edge tab, will fit between face cuts 14 and 15. In assembling the puzzle, this will provide a guide to accurately locate the inserted card horizontally, and face cuts 16 and 17 automatically provide a stop to accurately locate the inserted card vertically. This facilitates the accurate locating of the cards, so that the picture segments will properly align.

The construction of the rear layer 11 is best shown in FIG. 3, where a portion of the front layer 10 is graphically cut away. A rectangular space 18 is provided directly below each slot to provide space for the edge tab while the card is being inserted into the slot.

Since the cards are held entirely by the front layer 10, it is possible to eliminate the rear layer 11 with some sacrifice to the rigidity of the card holder. Simply holding the card holder in one hand will provide space below the slots. Resting the card holder on a soft surface, such as a rug, will permit the insertion of the edge tabs.

In many instances it is convenient to assemble the puzzle on a smooth hard surface, such as a table top. A card holder formed of a single layer 19 can be designed to provide space below the slots as shown in FIG. 4. Space is provided below all slots by raising the sheet material 19 above the table top. A tab 20 above each slot is curved to extend below the plane of the sheet material 19. This will maintain the necessary space below all slots.

Another modification to the cuts is also shown in FIG. 4. The face cuts forming the left edge and the right edge of the slot can be extended below the perpendicular face cuts as shown by face cuts 21 and 22. These face cuts act to hold the center position of the inserted card.

The cards can be made similar to ordinary playing cards as to size, material and thickness. All cards are identical in shape, including the edge tab at the bottom of each card. The edge tabs provide the means to insert the cards into the slots in the card holder.

The cards can be divided into three classes: the "beginning cards," the "middle cards" and the "end cards." Only one side of each card displays a picture segment. The face displaying the picture segment is referred to as the top side.

FIG. 5 shows both the top side and the underside of a typical "beginning card" 23. The top side of "beginning card" 23 is divided into two areas; the area in the top portion contains the picture segment 24 and the area in the lower portion contains the assembly information 25. The underside of the "beginning card" 23 contains information 26 which says "START 3." In assembling the puzzle, this card should be placed in the third column and top row to cover the information "START 3" printed on the card holder. The edge tab 27 is shown at the bottom of the card.

Figure 6:
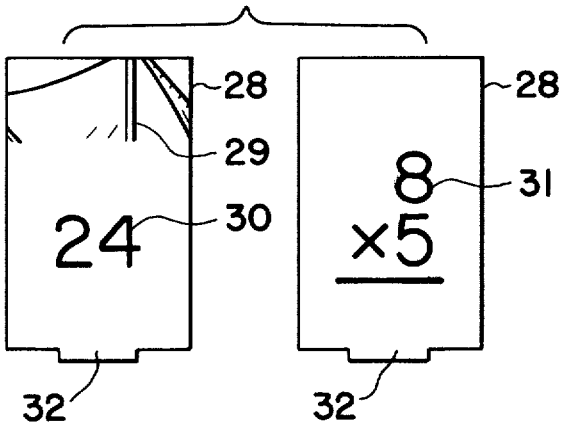
FIG. 6 is a front and rear view of a "middle card."

FIG. 6 shows both the top side and the underside of a typical "middle card" 28. The top side of the "middle card" 28 is divided into two areas; the area in the top portion contains the picture segment 29 and the area in the lower portion contains the assembly information 30. The edge tab 32 is shown at the bottom of the card. In assembling the puzzle, the assembly information 31 on card 28 can be correctly matched to the assembly information 25 on card 23; card 28 is then placed in the third column and second row to cover the assembly information 25 on card 23. Assembly information 30 on card 28 is now displayed.

Figure 7:
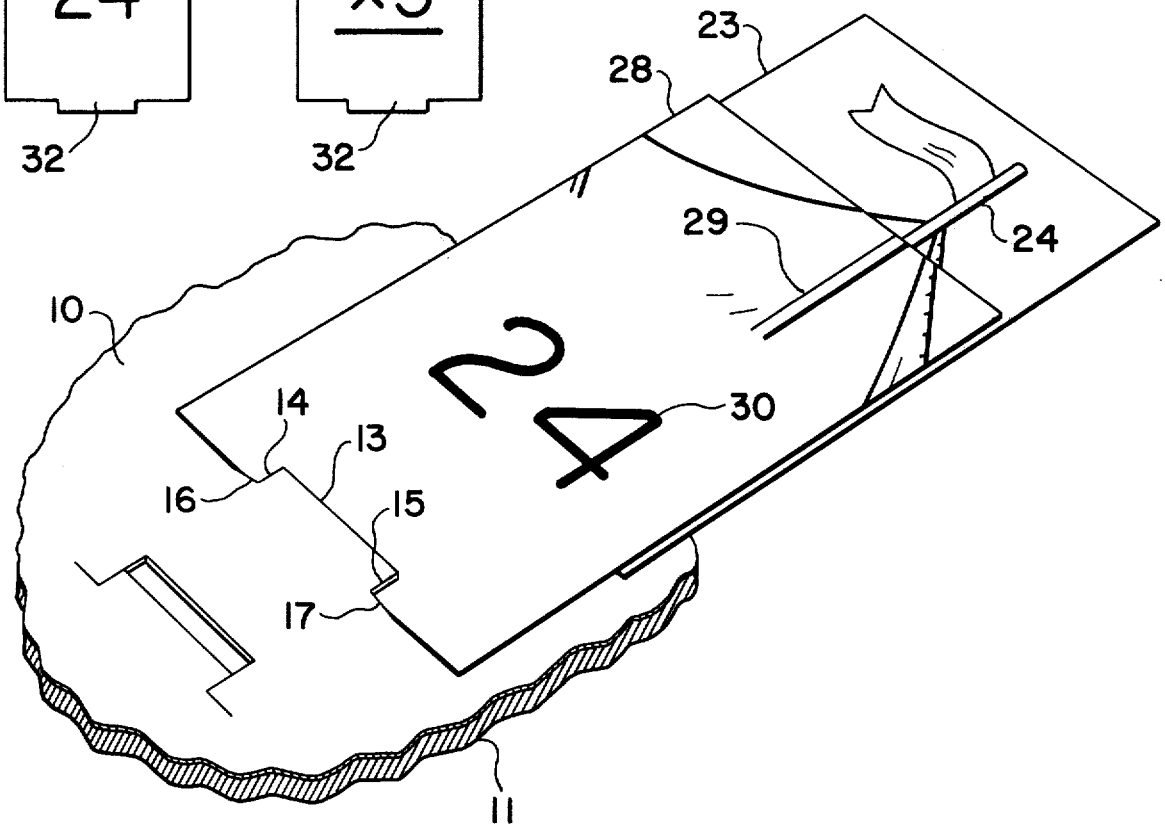
FIG. 7 is a perspective view of two cards inserted into a portion of the card holder.

FIG. 7 shows how the form of the picture segment 24 aligns with the form of the picture segment 29 when card 28 is positioned on the card holder immediately below card 23. The face tab formed by the edges 13, 14 and 15 is forced to raise to a distance no greater than the thickness of the inserted card 28. The pressure of the face tab against the inserted card 28 acts to hold the position of the card 28 substantially flat against card 23. The edges 16 and 17 connect the raised face tab to the plane of the front layer 10 of the card holder. This automatically provides a stop to accurately locate the inserted card 28.

Figure 8:
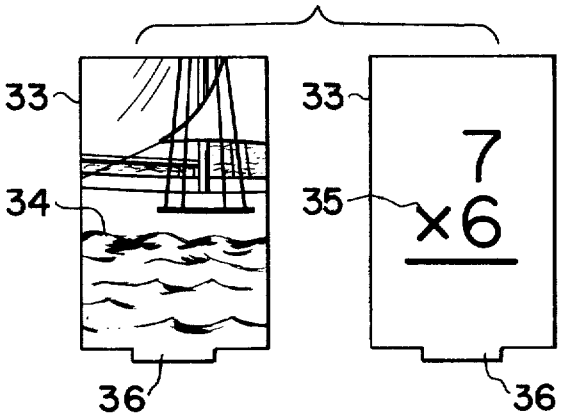
FIG. 8 is a front and rear view of an "end card."

FIG. 8 shows both the top side and the underside of a typical "end card" 33. The entire top side of the "end card" 33 contains a picture segment 34 and the underside contains assembly information 35. The edge tab 36 is shown at the bottom of the card.

The start information printed on the card holder and the underside of the "beginning cards" is used as a guide to correctly locate the first card of each column on the card holder. A plurality of puzzles can be made to have the same start information contained on the "beginning cards," but having different assembly information contained on the "middle cards" and "end cards." In this way one card holder can be standard for a plurality of puzzles with assembly information covering a plurality of subjects. Thus, additional puzzles can be purchased without the expense of additional card holders. If the manufacture and sale is not intended to include additional puzzles, then assembly information consistent with the assembly information on the "middle cards" and "end cards" can be used as the start information.

Figure 9:
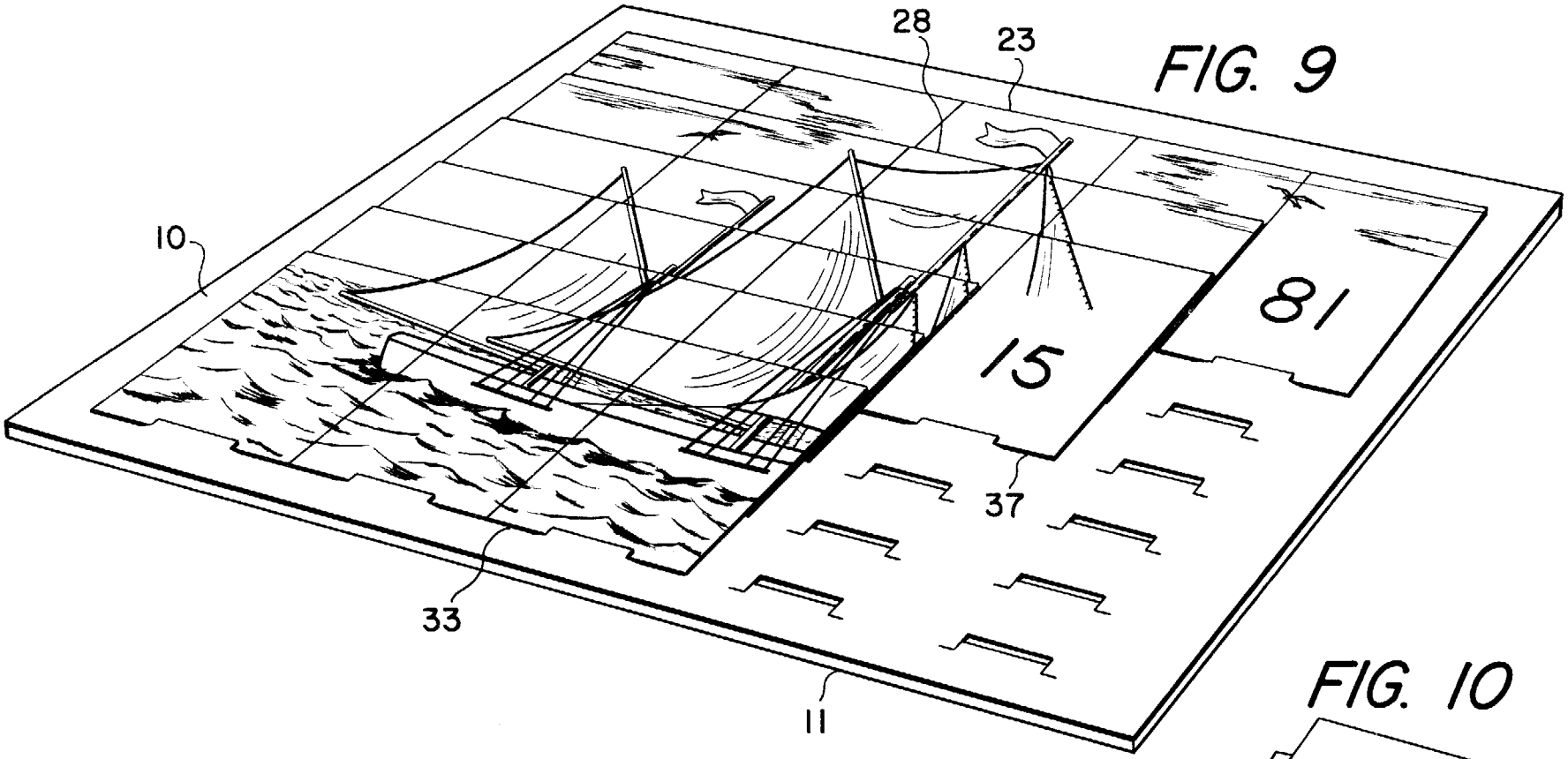
FIG. 9 is a perspective view of a partially assembled puzzle.
Figure 10:
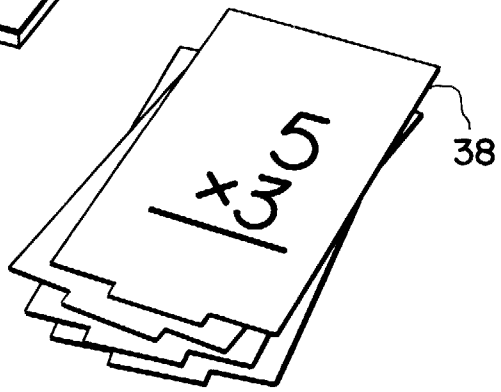
FIG. 10 is a perspective view of several loose cards to complement the puzzle in FIG. 9.

The overall formation of a partially solved puzzle is best shown in FIG. 9. Several loose cards not yet placed on the card holder in FIG. 9 is shown in FIG. 10. This puzzle is designed for 30 cards: five "beginning cards," 20 "middle cards" and five "end cards." There are five "beginning cards", fourteen "middle cards" and three "end cards" correctly in place. The assembly information displayed on the underside of card 38, shown in FIG. 10, can be correctly matched to assembly information on the top side of card 37, shown in FIG. 9. In assembling the puzzle, card 38 should now be turned over to expose the top side, and then placed on the slot immediately below the slot already occupied by card 37. Card 38 will then display new assembly information and add a picture segment to the overall formation of the picture.

As the assembly information is matched, the cards are inserted into the card holder, one immediately below the other. An "end card" in the bottom row indicates that a column is complete. There is no definite order as to which column is completed first, second, third, etc. When all cards are correctly in place, the picture will be complete and no assembly information will be exposed.

Although the card holder facilitates the positioning of cards, particularly for children under the age of ten years old, I have found that the card holder can be completely eliminated by attaching the cards to each other. This will reduce the manufacturing cost, since the entire puzzle comprises only a plurality of cards. FIGS. 11 through 14 shows one form of puzzle designed for attaching the cards to each other.

The cards can be made similar to ordinary playing cards as to size, material and thickness. With respect to the picture segments and the assembly information, the cards can be divided into three classes, exactly as described in the form consisting of a plurality of cards and a card holder.

Figure 11:
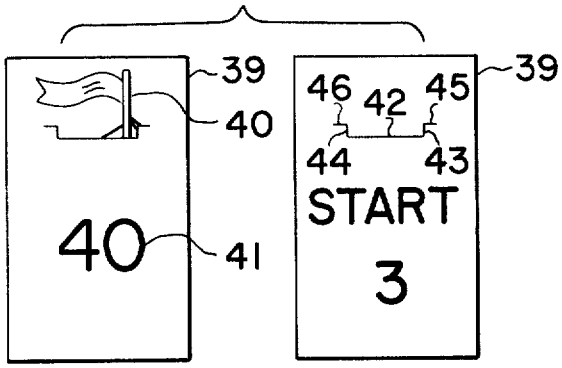
FIG. 11 is a front and rear view of a "beginning card" for a puzzle consisting only of cards.

FIG. 11 shows both the top side and the underside of a typical "beginning card" 39. The top side contains a picture segment 40 and the assembly information 41. The underside contains start information which says "START 3". In assembling the puzzle on a table top, card 39 will be the first card of the third column. It is not necessary to place the columns next to each other until all columns are completely assembled.

All "beginning cards" and "middle cards" are provided with cuts identical to cuts 42, 43, 44, 45 and 46. These cuts will also be referred to as face cuts. Face cuts 42, 43 and 44 are provided to form a face tab. The point where face cuts 43 and 45 meet and the point where face cuts 44 and 46 meet define the base of a typical face tab. Face cuts 45 and 46 are located on each side of the base of a typical face tab and extend away from each other.

An edge tab located on the top edge of each "middle card" and "end card" will fit between face cuts 43 and 44. In assembling the puzzle, this will provide a guide to locate the inserted card horizontally, and face cuts 45 and 46 automatically provide a stop to accurately locate the inserted card vertically. This facilitates the accurate locating of the cards with respect to each other, so that the picture segments will properly align.

Figure 12:
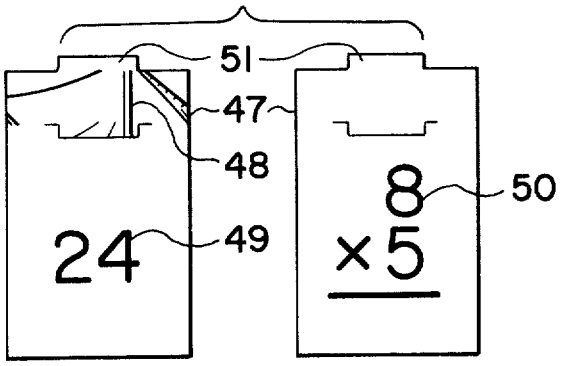
FIG. 12 is a front and rear view of a "middle card" for a puzzle consisting only of cards.

FIG. 12 shows both the top side and the underside of a typical "middle card" 47. The top side contains a picture segment 48 and assembly information 49. The underside contains the assembly information 50. Edge tab 51 is shown at the top of card 47.

Figure 13:
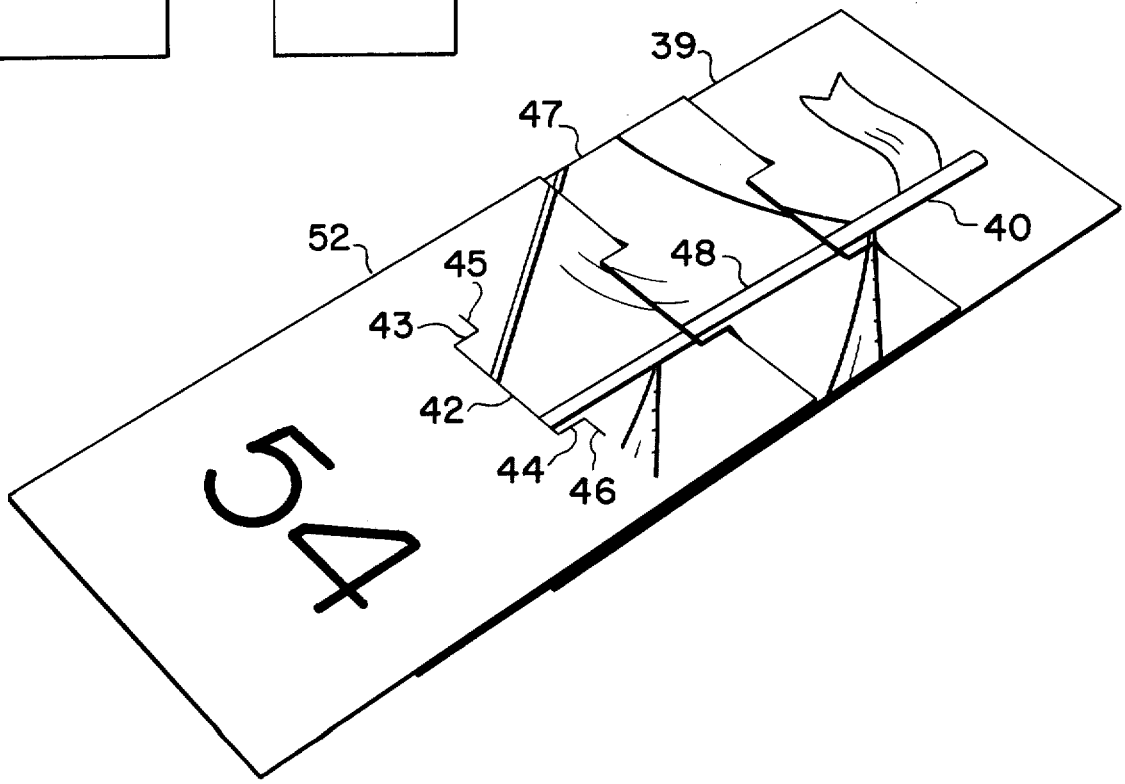
FIG. 13 is a perspective view of three cards attached to each other for a puzzle consisting only of cards.

FIG. 13 shows how the form of the picture segments align when three cards are attached to each other. The "middle card" 52 shows the typical face cuts 42 through 46. When attaching the next card to the column, the three cards can be held in one hand; then by bending the lower portion of card 52 downward, the edges formed by face cut 42 will separate. This will provide an opening to insert an edge tab under the face tab formed by face cuts 42, 43 and 44.

Figure 14:
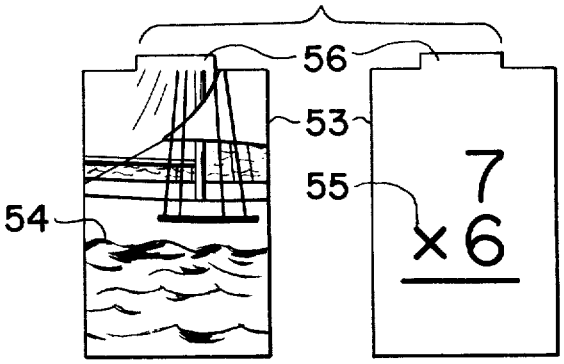
FIG. 14 is a front and rear view of an "end card" for a puzzle consisting only of cards.

FIG. 14 shows both the top side and the underside of a typical "end card" 53. The entire top side contains a picture segment 54 and the underside contains assembly information 55. The edge tab 56 is shown at the top of card 53.

Starting with each "beginning card," the puzzle is assembled in columns. If several people participate, each person can be assigned to assemble one or more columns. When all columns are completely assembled, they are placed next to each other to form the entire picture.

Figure 15:
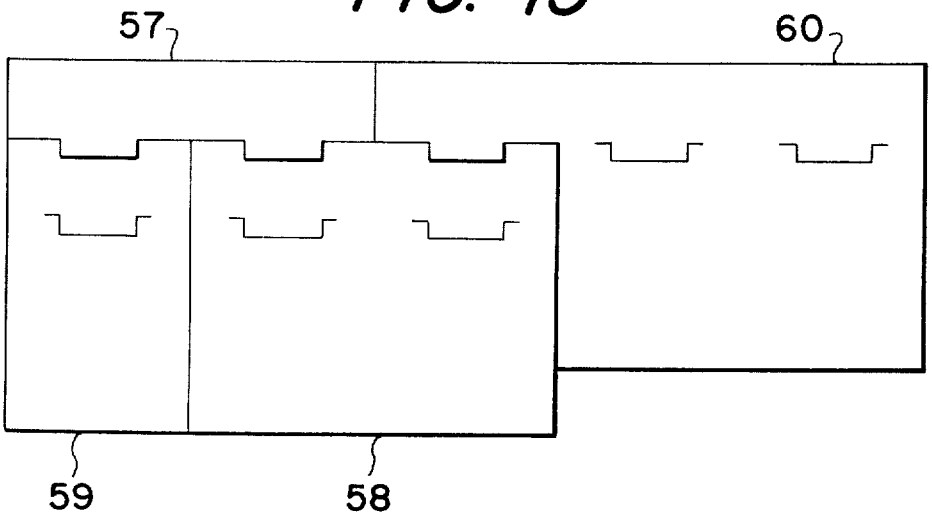
FIG. 15 is a front view of a modified form of several attached cards.

FIG. 15 shows a modified form of four attached cards. Cards 57 and 58 are twice the width of card 5, and card 60 is three times the width of card 59. An entire row can consist of only one extended card. By extending the width of several cards to be common to two or more columns, the columns will be held together. The area provided for the assembly information is increased proportionally to the increased width of each card.

For puzzles comprising a large number of cards, it is helpful to lock the cards together. This will prevent the cards from separating from each other while adding additional cards to a column.

Figure 16:
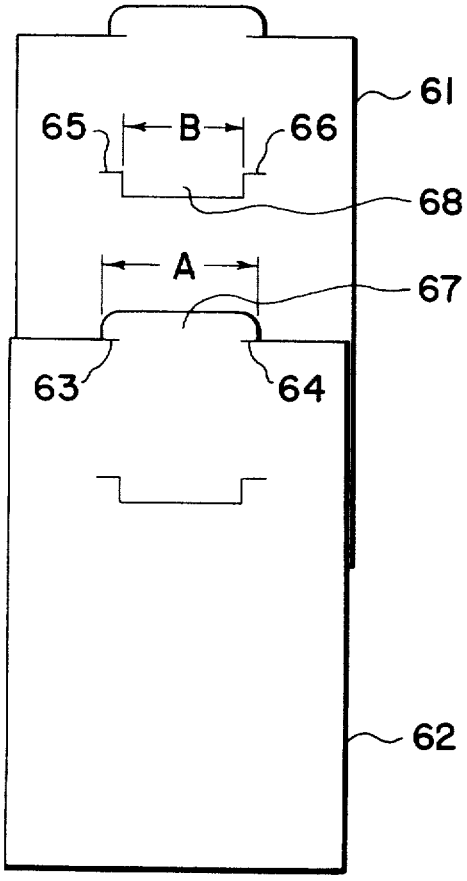
FIG. 16 is a front view of two cards having modified tabs for locking the cards together.

FIG. 16 shows a modified form of the edge tab 67 designed for locking the cards 61 and 62 together. The width A of the edge tab 67 located at the top of card 62 is greater than the width B of the face tab 68 in card 61. Cuts 63 and 64 are extended inwardly from the ends of edge tab 67 and will be referred to as edge cuts.

When the edge tab 67 at the top of cards 62 is fully inserted beneath the face tab 68 of card 61, the cards will lock together. Edge cut 63 will coincide with face cut 65 and edge cut 64 will coincide with face cut 66. The stresses within the material surrounding these cuts, cause the edges formed by these cuts that coincide to partially overlap each other — thus, locking the cards together.

Figure 17:
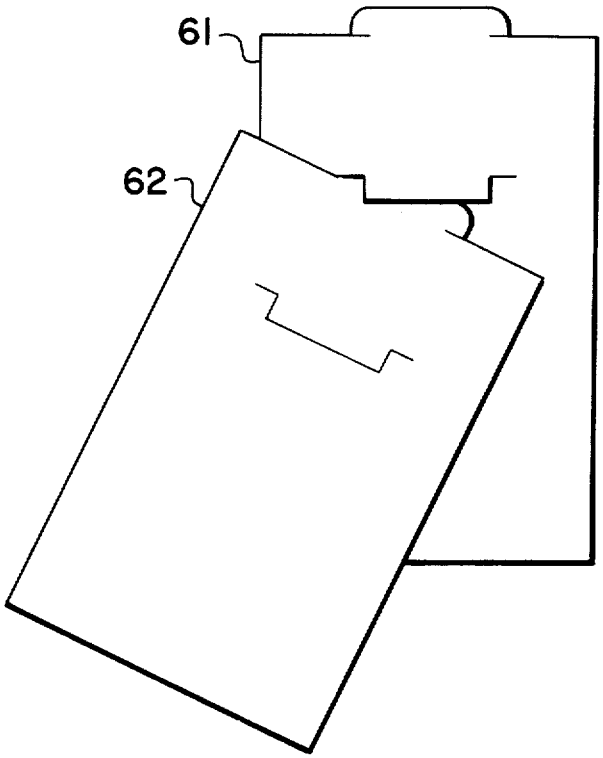
FIG. 17 is a front view of two cards being unlocked from each other.

Cards 61 and 62 can be easily unlocked from each other by sliding card 62 to the left and then rotating card 62 clockwise as shown in FIG. 17. The two cards can now be separated by sliding card 62 to the right and downward.

As can be seen, an educational puzzle is provided which allows each participant to apperceive new knowledge as well as delight in an entertaining experience. A picture is formed as cards with picture segments thereon are correctly matched with other cards by an existing informational relationship. Although general assembly information in many forms can be used in assembling the puzzle, this invention contemplates the use of educational information as a preferred form of assembly information. In such case, the correct relationships must be determined between cards having educational information thereon in order to correctly assemble the puzzle.

In one form of the invention, the cards have a tab formed on one edge that allows placement of the cards in a card holder to thus hold the cards in the correct position. In another form, the cards have a tab and cuts formed therein so that the cards may be interfitted to form the completed picture. The disclosed puzzle will provide hours of entertainment as well as affording an educational experience without outside assistance.

What is claimed:

1. A puzzle comprising a plurality of cards adapted to be arranged in a predetermined pattern in the completed form of a puzzle, location means on each of said cards providing for the disposition of said cards in said predetermined pattern in properly located positions of said cards, said cards being overlapped in said located positions thereof so that the combined exposed portions thereof form a picture, the non-exposed overlapped portions of the cards including information useable as a guide in the assembly of the puzzle.

2. A puzzle according to claim 1 wherein said location means comprises an edge tab formed on a selected edge of each of said cards.

3. A puzzle according to claim 2 wherein said plurality of cards is divided into three groups, a first group comprising beginning cards having a top side divided into two selected portions and an underside, one of said portions of said top side having a picture segment thereon and the other portion having assembly information thereon, said underside of said beginning cards having start information thereon, the second group comprising middle cards having a top side like said top side of said beginning cards, and an underside having assembly information thereon, and a third group comprising end cards having a top side with a picture segment thereon and an underside with assembly information thereon.

4. A puzzle according to claim 2 further including a card holder having a plurality of openings formed in a predetermined pattern therein to accommodate said tabs in said predetermined pattern of said cards.

5. A puzzle according to claim 4 wherein said openings comprise a plurality of slots formed in said card holder.

6. A puzzle according to claim 5 further including face cuts in said card holder forming a plurality of face tabs, each of said face tabs having a base and a free edge formed by a selected edge of one of said slots, and further including face cuts located on each side of the base of said face tabs and extending away from each other to thereby releasably hold said cards in a properly located substantially flat position.

7. A puzzle according to claim 4 wherein said openings comprise a plurality of slots formed in said card holder, and wherein said card holder is formed of two layers, a front layer having said slots formed therein and a rear layer having openings formed therein in alignment with said slots to accommodate said edge tabs.

8. A puzzle according to claim 7 further including face cuts in said front layer of said card holder forming a plurality of face tabs, each of said face tabs having a base and a free edge formed by a selected edge on one of said slots, and further including face cuts located on each side of the base of said face tabs and extending away from each other to thereby releasably hold said cards in a properly located substantially flat position.

9. A puzzle according to claim 4 wherein said card holder is formed of single layer construction and wherein said openings comprise a plurality of slots formed in said card holder, each of said slots having a curved selected edge extending below the plane of said card holder, and face cuts in said card holder forming a plurality of face tabs, each of said face tabs having a base and a free edge formed by an edge directly opposite to said first mentioned selected edge of said slots, and further including face cuts located on each side of the base of said face tabs and extending away from each other to thereby releasably hold said cards in a properly located substantially flat position.

10. A puzzle according to claim 1 wherein said locating means comprises an edge tab located on a selected edge of predetermined ones of said cards and further including face cuts formed in selected ones of said cards to provide openings during assembly so that said edge tabs may be inserted into said openings to provide for the disposition of said cards in said predetermined pattern.

11. A puzzle according to claim 10 wherein said face cuts in each of said cards form a face tab, each of said face tabs having a base, and including face cuts located on each side of said base and extending away from each other to thereby releasably hold said cards together in a properly located substantially flat position.

12. A puzzle according to claim 11 wherein the width of the base of each of said face tabs is shorter than the width of each of said edge tabs, edge cuts formed in each of said edge tabs extending inwardly from the ends thereof to be coincident in the assembled form with said face cuts located on each side of the base of said face tabs to thereby provide for releasably locking said cards together in a properly located substantially flat position.

13. A puzzle according to claim 11 wherein said plurality of cards is divided into three groups, the first group comprising beginning cards having said face cuts formed therein, a second group of cards comprising middle cards having said edge tab formed thereon and said face cuts formed therein, and a third group comprising end cards having said edge tab formed thereon.

14. A puzzle according to claim 13 wherein said plurality of cards comprises a top side and an underside, beginning cards having their top side divided into two portions, one portion having a picture segment located thereon and the other portion having assembly information thereon, the underside of said beginning cards having start information thereon, middle cards having a top side similarly divided as said beginning cards and having an underside with assembly information thereon, said end cards having a picture segment located on its top side and having assembly information located on its underside.

15. A puzzle according to claim 14 wherein said plurality of cards are formed into various widths, said widths being multiples of the width of said narrowest card so that a plurality of said cards can be commonly interfitted to a wider card to thus provide a greater area upon which assembly information may be located.

* * * * *